US005777254A

United States Patent [19]

Fay et al.

[11] Patent Number: 5,777,254

[45] Date of Patent: Jul. 7, 1998

[54] SYSTEM AND METHOD FOR CONTROLLING NOTE INVERSIONS DURING COMPUTER BASED MUSICAL PERFORMANCES

[75] Inventors: Todor C. Fay; David G. Yackley, both of Redmond, Wash.

[73] Assignee: Microsoft Corporation, Redmond, Wash.

[21] Appl. No.: 880,870

[22] Filed: Jun. 23, 1997

[51] Int. Cl.[6] ..... G10H 1/38; G10H 7/00

[52] U.S. Cl. ..... 84/613; 84/637; 84/669; 84/DIG. 22

[58] Field of Search ..... 84/613, 637, 650–652, 84/669, DIG. 22

[56] References Cited

U.S. PATENT DOCUMENTS 5,218,157 6/1993 Akagawa et al. ..... 84/637

5,235,126 8/1993 Bruti ..... 84/637 X

*Primary Examiner*—Stanley J. Witkowski

*Attorney, Agent, or Firm*—Jones & Askew, LLP

[57] ABSTRACT

The present invention provides a system and a method for intelligently controlling note inversions during a computer based musical performance. During a musical performance, notes of a track are transposed against a chord. In some instances, the resulting pitch of the transposed note may fall outside of an upper-pitch boundary or a lower-pitch boundary defined for the track. Two additional control mechanisms are examined to determine if the note should be inverted. One mechanism includes a chord inversion mask used for managing the inversion of notes within the context of the chord. Another mechanism includes a track inversion mask defining one or more series of ranges where inversions are allowed. If the pitch of a transposed note exceeds the upper-pitch boundary or the lower-pitch boundary, the chord inversion mask and the track inversion mask are scanned to determine if the note can be inverted. The scanning process includes looking at each position in the chord inversion mask and the track inversion mask between the exceeded boundary and the pitch of the transposed note. If a position is found in which the chord inversion mask and the track inversion mask allow inversions, then the note will be inverted.

12 Claims, 7 Drawing Sheets

SYSTEM AND METHOD FOR CONTROLLING NOTE INVERSIONS DURING COMPUTER BASED MUSICAL PERFORMANCES

RELATED APPLICATIONS

U.S. patent application Ser. No. 08/384,668, filed Feb. 6, 1995 entitled "Music Composition System for Enhancing a Multimedia Presentation", filed on and assigned to Microsoft Corporation of Redmond Washington, the assignee of the present application, is incorporated herein by reference. Application Ser. No. 08/384,668 discloses an exemplary embodiment of a music composition system that can serve as an operational environment for the present invention.

TECHNICAL FIELD

The present invention relates to computer-based musical performance devices and, more particularly, relates to enhancing the capabilities of a musical performance device by providing a method for controlling note inversions when notes are being played against a chord progression.

BACKGROUND OF THE INVENTION

Context-sensitive musical performances have become a key component of electronic and multimedia products such as stand-alone video games, computer based video games, computer based slide show presentations, computer animation, and other similar products and applications. As a result, music generating devices and/or music playback devices have been more highly integrated into electronic and multimedia products. Previously, musical accompaniment for multimedia products was provided in the form of pre-recorded music that could be retrieved and performed under various circumstances. Using pre-recorded music for providing context-sensitive musical performances has several disadvantages. One disadvantage is that the pre-recorded music requires a substantial amount of memory storage. Another disadvantage is that the variety of music that can be provided using this approach is limited due to memory constraints. Thus, the musical accompaniment for multimedia devices utilizing this approach is wasteful of memory resources and can be very repetitious.

Today, music generating devices are directly integrated into electronic and multimedia products for composing and providing context-sensitive, musical performances. These musical performances can be dynamically generated in response to various input parameters, real-time events, and conditions. For instance, in a graphically based adventure game, the background music can change from a happy, upbeat sound to a dark, eerie sound in response to a user entering into a cave, a basement, or some other generally mystical area. Thus, a user can experience the sensation of live musical accompaniment as he engages in a multimedia experience.

U.S. patent application Ser. No. 08/384,668 entitled "Music Composition System for Enhancing a Multimedia Presentation", discloses a music generating device that can be integrated into multimedia products. FIG. 1 is a block diagram of a system incorporating this music generating device. In general, the system includes a composing component, a performance component, a musical instrument interface component and a control component. The system illustrated in FIG. 1 depicts the composing component as a composition engine 14, the performance component as a performance engine 16, the instrument interface component as an MIDI interface 39, and the control component as an arbitrator 12 interacting with an application program 36 and data storage 27. The application program 36 operates to control a multimedia presentation such as a video game or a slide show presentation.

During the multimedia presentation, the arbitrator 12 receives from the application program 36, input parameters and information that can be interpreted for selecting or modifying the Shape, Style and Personality of the musical performance. Based on the interpretation of this information, the arbitrator 12 may access data storage 27 to obtain musical sections and styles (to be defined following) to be passed to performance engine 16. Alternatively, the arbitrator 12 can pass composition parameters to composition engine 14. In response, the composition engine 14 composes musical sections and passes them to performance engine 16 for being performed or to arbitrator 12 for storage.

The performance engine 16 receives musical sections and musical styles as inputs. A musical style contains a series of time-stamped musical data including musical notes, with each note being associated with a specific track or channel number. The time-stamp indicates the order and relative timing for playing the notes. The track or channel number is used to identify a group of notes that are intended for a specific instrument or musical function such as a melodic line. For instance, one track may be associated with the piano part, another track the bass part, and another track the strings part, etc. A musical section includes a chord progression that the musical notes of the musical style are played against.

The performance engine 16, generates a musical sequence (also referred to herein as a sequence of performance notes) based on the input of a musical style and a chord progression in the musical section. The musical sequence identifies the notes to be played by a musical device driven by the performance engine 16. For instance, the musical sequence may contain data to be provided to a musical device through an instrument interface 39 such as a Musical Instrument Digital Interface (MIDI).

One of the functions of the performance engine 16, or a similar performance component in a comparable system, is to adjust the note sequences in each of the tracks of a musical sequence based on the chords of the chord progression. In musical terminology, the notes of a musical track are transposed or mapped to a different pitch when played against a chord. Under some circumstances, a note may be transposed to a pitch that is outside of a desired range of pitch or the range of an instrument. When this occurs, the note may be inverted. The inversion process involves changing the pitch of a note by either transposing the note up or down one or more octaves, forcing the note to fall within the desired range of pitch.

Previous systems, such as the one disclosed in U.S. patent application Ser. No. 08/384,668, use an upper-pitch and lower-pitch boundary to define a desired range of pitch. These boundaries are fixed values such as specific Musical Instrument Data Interface ("MIDI") note values. Each track within a style includes a MIDI note representing the upper-pitch boundary and another MIDI note representing the lower-pitch boundary of the desired range of pitch. Using this technique, when a note is transposed beyond one of these boundaries, the note is adjusted either up or down the appropriate number of octaves required to force the note within the boundaries.

This technique of performing inversions during a musical performance has disadvantages. One disadvantage is realized when a musical performance includes a melodic run, or sequence of notes, that should be maintained in a specific harmonic relationship. When the sequence of notes are transposed against a chord, one or more of the notes in the sequence may fall outside of one of the boundaries. This will result in an inversion of these notes, and thus, breaking up the melodic run. Current techniques do not provide a method to prevent a sequence of notes from being broken up under these circumstances. Thus, there is a need for a system and a method that allows note inversions to be prevented when a note or a sequence of notes must be maintained in a specific harmonic relationship such as a melodic run.

Another disadvantage of this technique is realized when the notes of a musical performance are played against certain chords. It may be desirable to prevent inversions from occurring when a note falls on one of the intervals of the chord. Also, to obtain a desired musical sound, it may be necessary to prevent inversions over a specific range of a chord. Yet another disadvantage of this technique is realized when the notes of a chord fall outside the boundaries of the required range of pitch. In this case, one or more notes of the chord may be inverted. Thus, there is a need for a system and a method that allows note inversions to be limited or suspended as a function of the chord that is currently being played.

Therefore, there may be seen a need in the art for a system and method that provides an intelligent inversion capability, wherein additional factors, other than simple range boundaries, can be used in the determination of when and where note inversions can occur during a musical performance.

SUMMARY OF THE INVENTION

The present invention provides a system and a method for controlling the inversions of notes during a performance of musical data. Initially musical data is received from a source such as a composition device, a live composer, or a storage media. The musical data includes a series of notes with each note being associated with one of several tracks. Each track includes a lower-pitch boundary and an upper-pitch boundary. These boundaries define a no-inversion range in which note inversions are not allowed. The boundaries of the no-inversion range are dynamically changed by comparing a set of active inversion masks to the no-inversion zone. The upper boundary of the no-inversion zone is increased to the first point in the set of active inversion masks that allow inversions above the upper boundary. Likewise, the lower boundary of the no-inversion zone is decreased to the first point in the set of active inversion masks that allows inversions below the lower boundary. In one embodiment, the set of active inversion masks includes a track inversion mask and a chord inversion mask. The track inversion mask that identifies scale intervals where inversions are allowed over the note range of a track. The chord inversion mask identifies points where inversions are allowed over a two octave range extending from a root note of a chord.

During the musical performance, each note is selected in accordance with a time stamp and is then played against a chord. If transposing the note against the chord results in the pitch of the note falling within the upper-pitch boundary and the lower-pitch boundary, then no inversions are performed. However, if the pitch of the note is outside of this range, then an inversion may be performed depending on the track inversion mask and the chord inversion mask. Both the track inversion mask and the chord inversion mask are examined between the boundary of the no-inversion range that was exceeded and the pitch value of the transposed note. If a scale interval allowing inversions exists in the track inversion mask that shares a common pitch value with an inversion point existing in the chord inversion mask, then an inversion will be performed. Thus, a transposed note falling outside of the upper-pitch or lower-pitch boundaries will only be inverted if allowed in the chord inversion mask and the track inversion mask. This advantageously allows a composing source to prevent inversions from occurring at undesired points such as melodic runs or certain chord positions.

In an alternative embodiment, only the track inversion mask is used as an additional control when a note is transposed outside of the no-inversion range. In another embodiment, only the chord inversion mask is used as an additional control when a note is transposed outside of the no-inversion range.

Thus, the present invention includes a system and a method for controlling note inversions as a function of a chord that notes are being played against. In addition, the present invention includes a system and a method for controlling note inversions as a function of a track by preventing inversions over a sequence of notes to maintain a specific harmonic relationship between the notes.

These and other aspects, features, and advantages of the present invention will be more clearly understood and appreciated from a review of the following detailed description of the present invention and possible embodiments thereof, and by reference to the appended drawings and claims.

DETAILED DESCRIPTION

Figure 1:
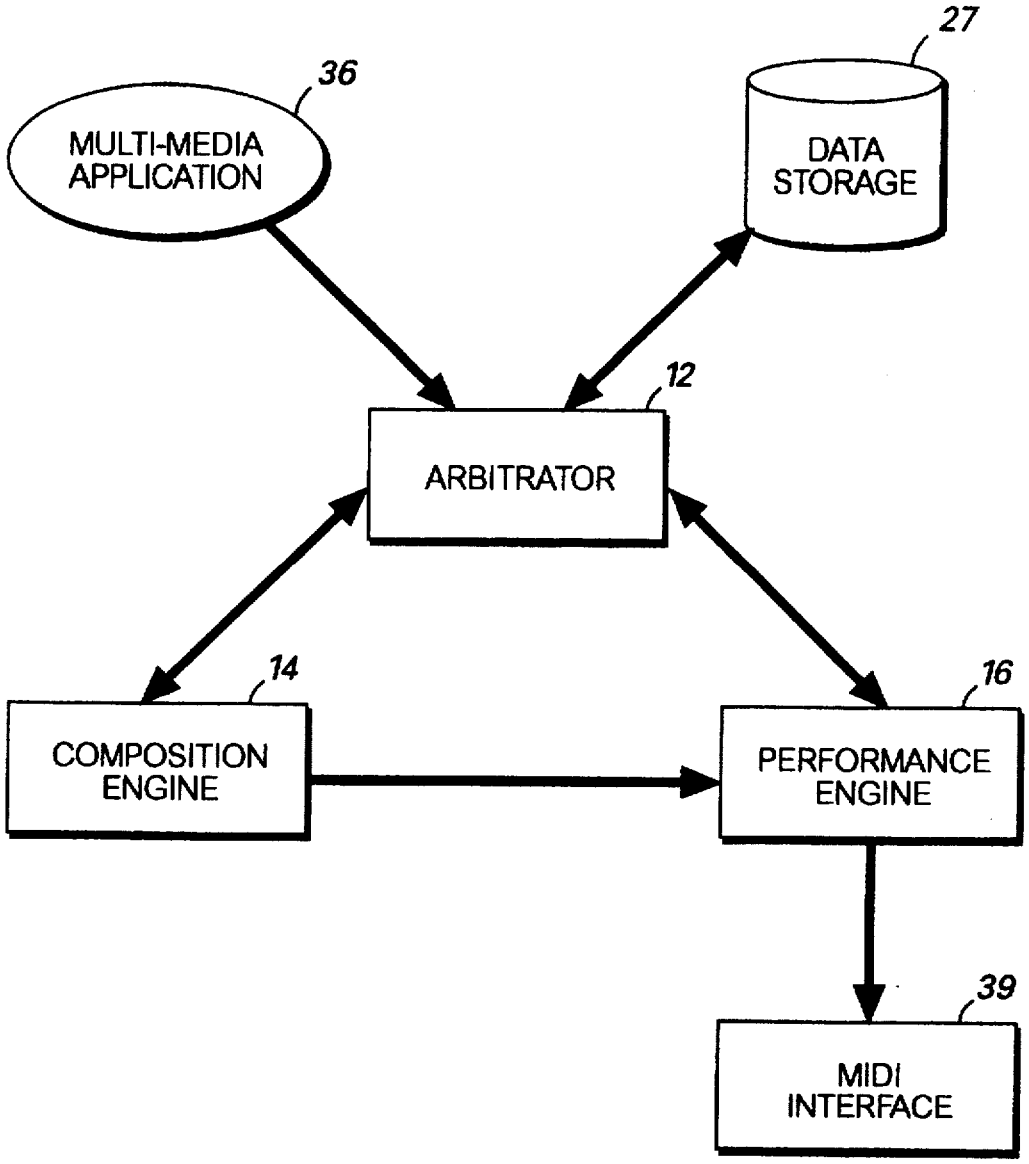
FIG. 1 is a block diagram illustrating a general architecture of a musical generating system.

The present invention is directed toward improving the musical sound quality of a computer based musical performance. More specifically, the present invention provides enhanced capabilities in converting and processing musical data, including chord progressions and notes received from a composing source, into musical notes. The enhanced capabilities provided by the present invention increase the control and flexibility in performing inversions of notes being played against a chord progression. As previously described in reference to FIG. 1, an exemplary system architecture embodying the present invention can be described as including the functional components of: an arbitrator 12; a composition engine 14; a performance engine 16; an instrument interface 39; and data storage 27.

In reference to this exemplary system architecture, aspects of the present invention include improvements to the performance engine 16. Although the aspects of the present invention are generally described in reference to this exemplary system architecture, the present invention is also applicable in other comparable system architectures that include the equivalence of a performance component that generates a musical sequence by mapping or transposing notes against chords of a chord progression.

Generally, the present invention provides enhancements to the performance engine component of the exemplary architecture by increasing the control and flexibility in performing inversions of notes being played against a chord progression. Thus, inversions may be restricted or prevented in various manners to prevent breaking up melodic runs and chords. In addition, desired musical sounds can be obtained by restricting or preventing inversions over specific intervals or ranges of a chord. In the most general sense, the present invention dynamically adjusts the boundaries of a no-inversion zone based on musical parameters of a musical performance. One or more inversion masks are provided as input in conjunction with an upper-pitch and lower-pitch boundary. Each inversion mask is associated with an aspect of the musical performance. In one embodiment, an inversion mask is provided with each chord and each track of a musical performance. The inversion masks are then merged with the upper-pitch and lower-pitch boundary to define the no-inversion zone. Thus, as different chords are played during the musical performance, the boundaries of the no-inversion zone are modified. In addition, each track in the musical performance can have unique boundaries defining the no-inversion zone.

Referring now to the drawings, in which like numerals represent like elements through the several figures, these aspects of the present invention and the preferred operating environment will be described.

Exemplary Operating Environment

Figure 2:
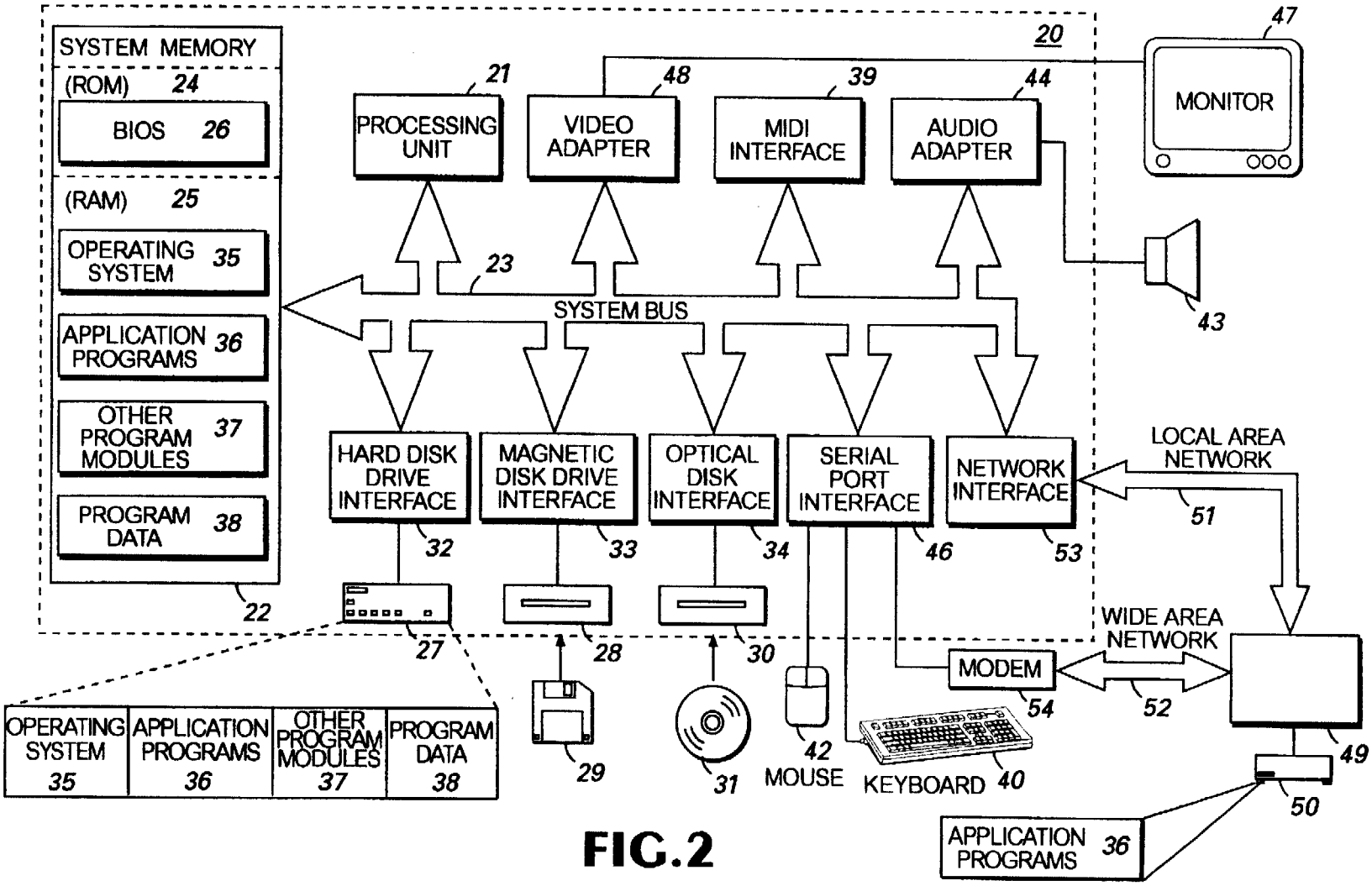
FIG. 2 is a system diagram that illustrates an exemplary environment suitable for implementing embodiments of the present invention.

FIG. 2 is a system diagram that illustrates an exemplary environment suitable for implementing embodiments of the present invention. FIG. 2 and the following discussion are intended to provide a brief, general description of a suitable computing environment in which the invention may be implemented. While the invention will be described in the general context of an application program that runs on an operating system in conjunction with a personal computer, those skilled in the art will recognize that the invention also may be implemented in combination with other program modules or application programs as well as a combination of interacting hardware and software components.

Generally, program modules include routines, programs, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

The exemplary system illustrated in FIG. 2, includes a conventional personal computer 20, including a processing unit 21, system memory 22, and a system bus 23 that couples the system memory to the processing unit 21. The system memory 22 includes read only memory (ROM) 24 and random access memory (RAM) 25. The ROM 24 provides storage for a basic input/output system 26 (BIOS), containing the basic routines that help to transfer information between elements within the personal computer 20, such as during start-up. The personal computer 20 further includes a hard disk drive 27, a magnetic disk drive 28 for the purpose of reading from or writing to a removable disk 29, and an optical disk drive 30 for the purpose of reading a CD-ROM disk 31 or to read from or write to other optical media. The hard disk drive 27, magnetic disk drive 28, and optical disk drive 30 interface to the system bus 23 through a hard disk drive interface 32, a magnetic disk drive interface 33, and an optical drive interface 34, respectively. The drives and their associated computer-readable media provide nonvolatile storage for the personal computer 20. Although the description of computer-readable media above refers to a hard disk, a removable magnetic disk and a CD-ROM disk, it should be appreciated by those skilled in the art that other types of media which are readable by a computer, such as magnetic cassettes, flash memory cards, digital video disks, Bernoulli cartridges, and the like, may also be used in the exemplary operating environment.

A number of program modules may be stored in the drives 27–30 and RAM 25, including an operating system 35, one or more application programs 36, other program modules 37, and program data 38. A user may enter commands and information into the personal computer 20 through a keyboard 40 and pointing device, such as a mouse 42. Other input devices (not shown) may include a microphone, joystick, track ball, light pen, game pad, scanner, camera, or the like. These and other input devices are often connected to the processing unit 21 through a serial port interface 46 that is coupled to the system bus, but may be connected by other interfaces, such as a game port or a universal serial bus (USB). A computer monitor 47 or other type of display device is also connected to the system bus 23 via an interface, such as a video adapter 48. One or more speakers 43 are connected to the system bus via an interface, such as an audio adapter 44. In addition to the monitor and speakers, personal computers typically include other peripheral output devices (not shown), such a printers and plotters.

The personal computer 20 includes a musical instrument digital interface ("MIDI") adapter 39 that provides a means for the PU 21 to control a variety of MIDI compatible devices (i.e., electronic keyboards, synthesizers, etc.) as well as receive MIDI events from the same. The MIDI adapter operates by receiving data over the system bus 23, formatting the data in accordance with the MIDI protocol, and transmitting the data over a MIDI bus 45. The equipment attached to the MIDI bus will detect the transmission of the MIDI formatted data and determine if the data is to be accepted and processed or ignored.

The personal computer 20 may operate in a networked environment using logical connections to one or more remote computers, such as a remote computer 49. The remote computer 49 may be a server, a router, a peer device or other common network node, and typically includes many or all of the elements described relative to the personal computer 20, although only a memory storage device 50 has been illustrated in FIG. 2. The logical connections depicted in FIG. 2 include a local area network (LAN) 51 and a wide area network (WAN) 52. These types of networking environments are commonplace in offices, enterprise-wide computer networks, intranets and the Internet.

When used in a LAN networking environment, the personal computer 20 is connected to the LAN 51 through a network interface 53. When used in a WAN networking environment, the personal computer 20 typically includes a modem 54 or other means for establishing communications over the WAN 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Exemplary Embodiment

The present invention provides increased control and flexibility in performing inversions of notes being played against a chord progression. This is accomplished by using additional factors in determining if an inversion should be performed. These additional factors include: (1) setting inversion ranges associated with each chord in a chord progression by using a chord inversion mask; and (2) setting inversion ranges to be associated with each track of a musical style by using a track inversion mask. Each of these factors can be used by itself or in conjunction with each other for controlling note inversions outside of a no-inversion range defined by an upper-pitch and lower-pitch boundary.

Chord Inversion Mask

Setting inversion ranges in each chord of a chord progression includes storing inversion points directly into the data structures that define the chord or by providing additional information with the chord. In addition, if the chord progression contains a polychord composed of multiple chords, each chord in the polychord can include inversion information. The data structure in an exemplary embodiment represents each chord by including four fields: chord definition, scale definition, chord inversion mask, and root note. The first three fields are 24-bit fields with each bit representing a consecutive note in a two octave range and each octave including 12 semitone steps. In the chord definition field, each bit in the 24-bit field is set if the note corresponding with the bit is a member of the chord. In the scale definition field, each bit in the 24-bit field is set if the note corresponding with the bit is a member of the scale. The chord inversion mask is used to identify notes at which inversions are not allowed. Thus, in an exemplary embodiment, setting a bit in the 24-bit field can be used to indicate that inversions are allowed at that point. The root note field establishes an offset from lowest note for the chord, scale, and chord inversion mask fields. Thus, the two octave range represented by the chord, scale, and chord inversion mask fields is based on the root note field.

Figure 3:
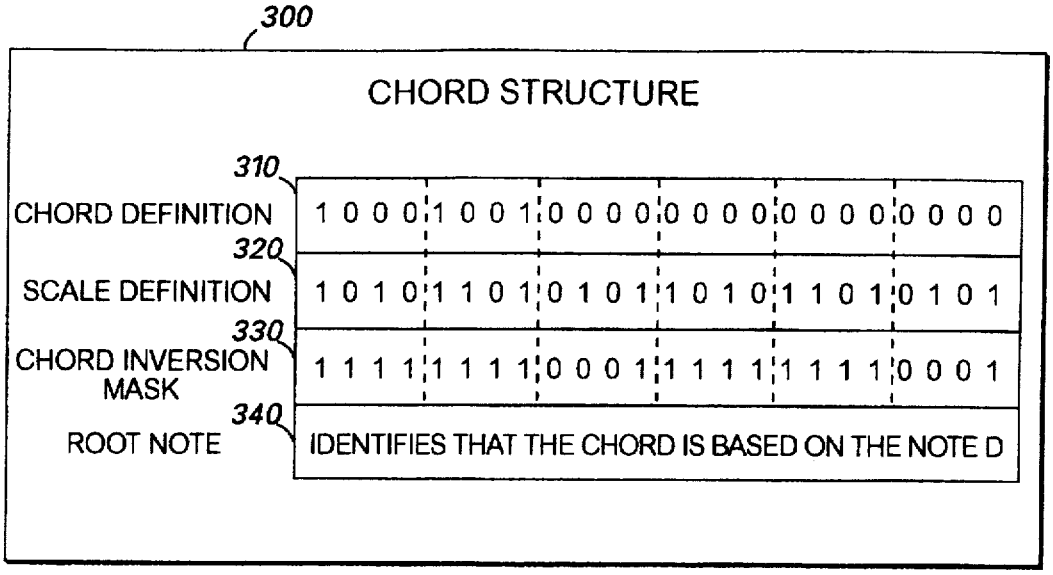
FIG. 3 is a block diagram illustrating an example of the data structure for a chord in the exemplary embodiment.

FIG. 3 is a block diagram illustrating an example of the data structure for a chord in the exemplary embodiment. The chord structure 300 includes a chord definition 310, a scale definition 320, a chord inversion mask 330, and a root note 340. The chord definition 310, scale definition 320, and chord inversion mask 330 are illustrated as 24-bit fields with a dashed line being drawn between each 4-bit nibble. The left-most bit of each 24-bit field represents the lowest pitch in the range of that field. The chord definition 310 illustrates the notes of a C triad chord. The scale definition 320 identifies a major scale. The root note 340 indicates that the chord is based on the note D. The chord inversion mask indicates that inversions are allowed except between the 5th and 7th of the chord.

Figure 4:
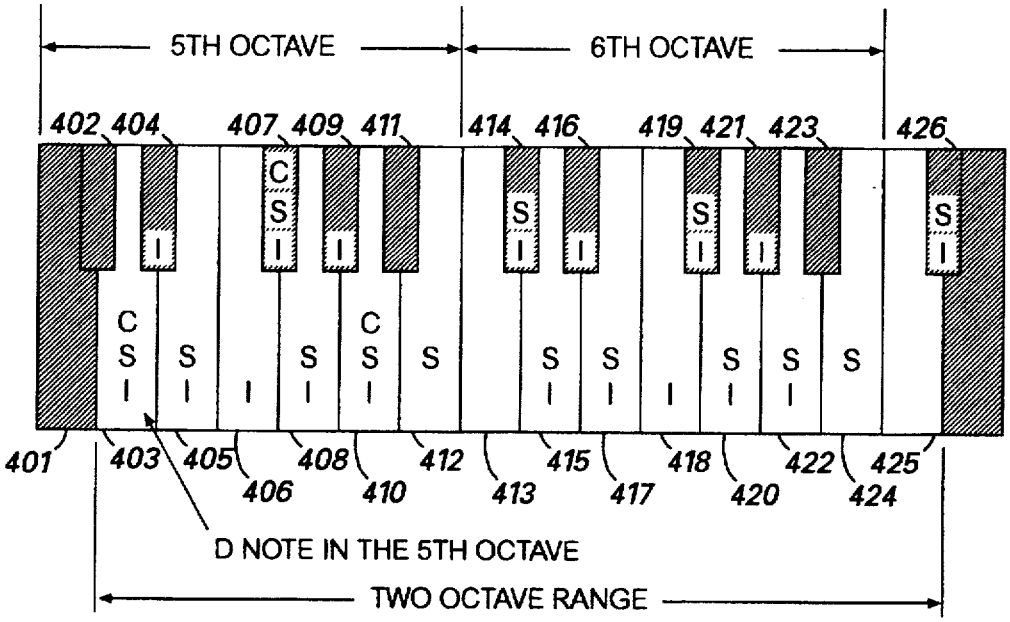
FIG. 4 is a diagram of the pertinent portion of a keyboard relative to the example chord structure 300 of FIG. 3.

FIG. 4 is a diagram of the pertinent portion of a keyboard relative to the example chord structure 300 in FIG. 3. The keyboard keys 401–412 represent the notes of the 5th octave and the keyboard keys 413–424 represent the notes of the 6th octave. Key 403 corresponds with the D note in the 5th octave (i.e., root note 240 of FIG. 3). When the chord definition 310 is offset by the root note 340 (shown in FIG. 3), the notes correspond with keyboard keys 403, 407, and 410. These keys are further identified in FIG. 4 by the character 'C'. Similarly, the scale definition 320 offset by the root note 340 (shown in FIG. 3) correspond with the keyboard keys 403, 405, 407, 408, 410, 412, 414, 415, 417, 419, 420, 422, 424, and 426. These keys are further identified in FIG. 4 by the character 'S'. Finally, the chord inversion mask 330 offset by the root note 340 (shown in FIG. 3) corresponds with the keyboard keys 403, 404, 405, 406, 407, 408, 409, 410, 414, 415, 416, 417, 418, 419, 420, 421, 422, and 426. These keys are further identified in FIG. 4 by the character 'T'.

The chord inversion mask provides additional control and flexibility in identifying locations to allow note inversions. If all 24-bits of the chord inversion mask are set, then the chord inversion mask does not restrict note inversions. However, if it is desirable to prevent particular notes from being inverted, the corresponding bits in the chord inversion mask can be cleared.

Track Inversion Mask

Setting inversion ranges for each track in a musical style involves representing an inversion mask for all of the scale intervals in the note range of the track. In the exemplary embodiment, this is accomplished by using an octet or eight-bit byte to represent the scale intervals of each octave. In a standard ten octave MIDI scale, ten octets are required. Because, each octave contains seven scale intervals, one bit in each byte is unused. In alternative embodiments, a 70-bit mask may be used or some other similar representation.

The track inversion mask provides additional control and flexibility in identifying locations to allow note inversions. If each bit of an octet is set, then the track inversion mask does not restrict note inversions at the scale intervals within the octave represented by the octet. However, if it is desirable to prevent particular notes from being inverted, the corresponding bits in the octet can be cleared.

Enhanced Note Inversion Determination

Figure 5:
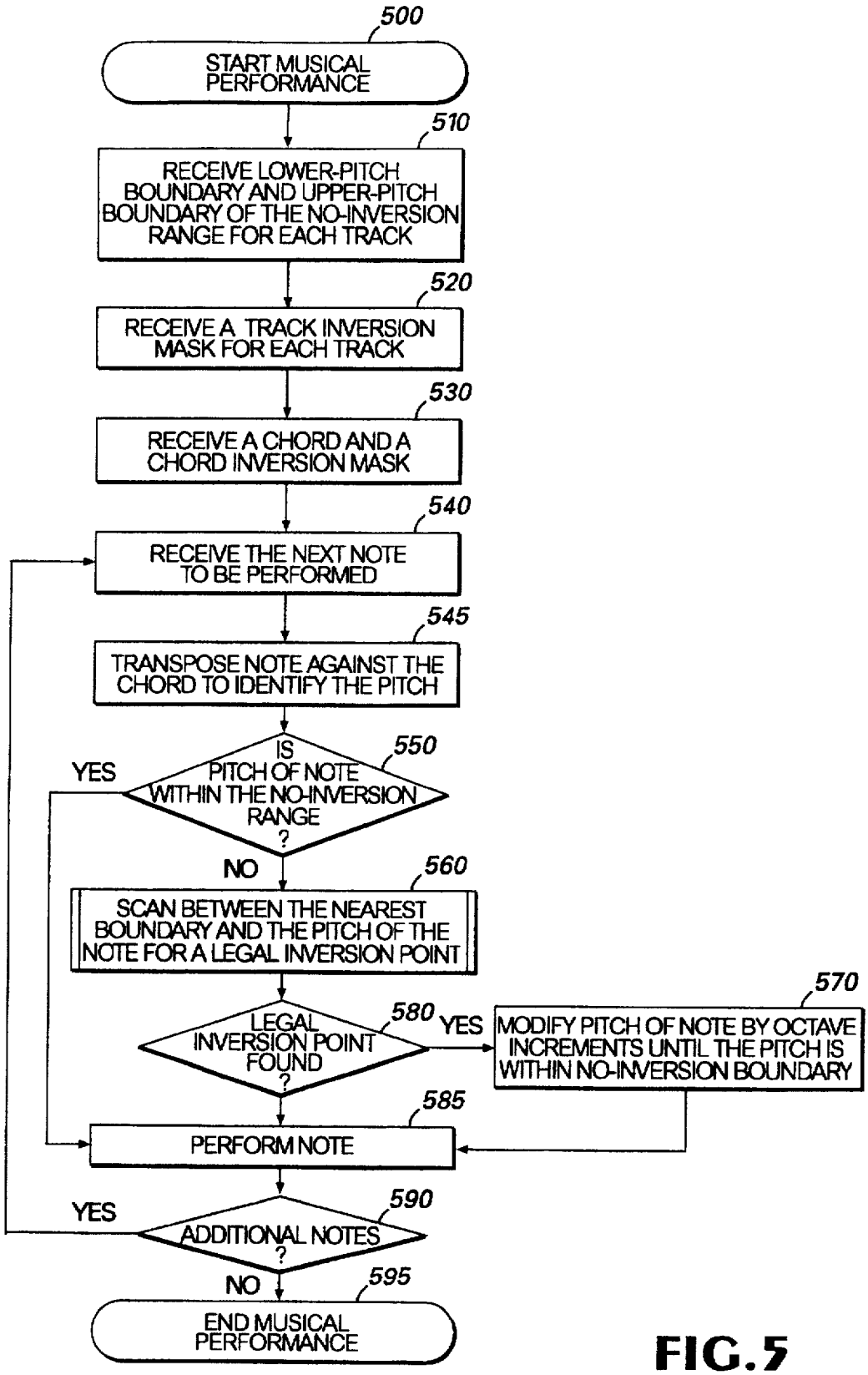
FIG. 5 is a flow diagram illustrating the enhanced note inversion determination solution of an exemplary embodiment.

FIG. 5 is a flow diagram illustrating the enhanced note inversion determination solution of an exemplary embodiment. Step 500 indicates the start of a musical performance. At step 510, a lower-pitch boundary and an upper-pitch boundary are received for each track. The lower-pitch boundary and the upper-pitch boundary may correspond with MIDI note values. The two boundaries identify a range of notes over which inversion are not permitted (no-inversion range). At step 520, a track inversion mask is received for each track. In the exemplary embodiment, the track inversion masks are integrated within a musical style. In alternative embodiments, the track inversion masks can be provided in addition to a musical style. At step 530, a chord structure including a chord inversion mask is received. During the musical performance, several chord structures may be received as a chord progression. However, for illustrative purposes, it is assumed that only a single chord is received during the musical performance.

At step 540, the next note to be performed is received and at step 545 the note is transposed against the chord. In the exemplary embodiment, the notes are extracted from the musical style based on a time stamp provided with each note. Each note is associated with a particular track, and hence, a particular track inversion mask. At step 550, the pitch associated with the transposed note of a track is compared to the upper-pitch and lower-pitch boundaries defining the initial no-inversion zone for that track. If the pitch of the note is within the initial no-inversion range, then the note is performed at step 585 without being inverted and processing continues at step 590. However, if the pitch of the note is not within the initial no-inversion range, processing continues at step 560.

At step 560, a routine is used to scan for a legal inversion point outside of the initial no-inversion zone. The scan is performed between the pitch of the note and the boundary of the initial no-inversion range that is nearest to the pitch of the note. The details of this routine are described later in reference to FIG. 6. If a legal inversion point is identified, the processing continues at step 570. Otherwise, the note is performed without being inverted and processing continues at step 590. Thus, points outside of the initial no-inversion zone that do not allow inversions, effectively change the boundary of the no-inversion zone.

At step 570, the note is inverted to force the pitch of the note within the initial no-inversion range. The inversion process either adds or subtracts octave sized increments from the pitch of the note until the pitch is within the initial no-inversion range. If the initial pitch of the note was less than the lower-pitch boundary, then octave sized increments are added to the pitch of the note. If the initial pitch of the note was greater than the upper-pitch boundary, then octave sized increments are subtracted from the pitch of the note. Once the note is within the initial no-inversion range, the note is performed at step 585 and processing continues at step 590.

At step 590, if additional notes remain to be performed, processing returns to step 540 to select the next note. If no additional notes remain, then the musical performance ends at step 595.

Figure 6:
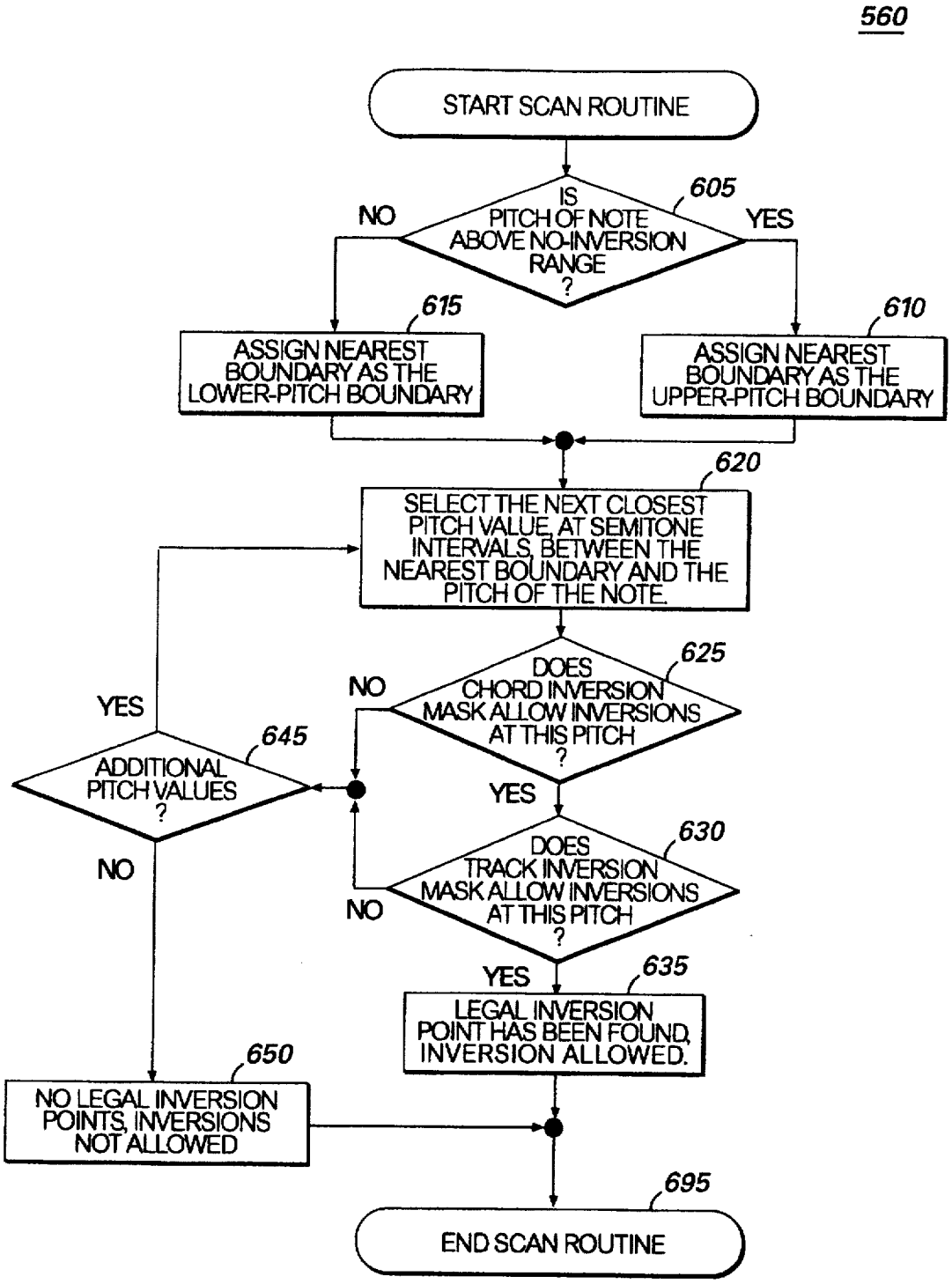
FIG. 6 is a flow diagram illustrating the scan routine 560 of FIG. 5.

FIG. 6 is a flow diagram illustrating the scan routine 560 of FIG. 5. At step 605, if the pitch of the note is above the initial no-inversion range, processing continues at step 610. If the pitch is below the initial no-inversion range, processing continues at step 615. At step 610, the upper-pitch boundary is assigned as the nearest boundary for the scan routine. Likewise, at step 615, the lower-pitch boundary is assigned as the nearest boundary. In either case, processing continues at step 620.

At step 620, the next pitch value between the nearest boundary and the pitch of the note is selected. At step 625, the chord inversion mask is examined with respect to the selected pitch value. If the chord inversion mask allows inversions at the point identified by the selected pitch value, then processing continues at step 630. However, if the chord inversion mask does not allow inversions at the point identified by the selected pitch value, then processing continues at step 645.

At step 630, the track inversion mask is examined with respect to the selected pitch value. If the track inversion mask allows inversions at the point identified by the selected pitch value, then processing continues at step 635. However, if the track inversion mask does not allow inversions at the point identified by the selected pitch value, then processing continues at step 645. Thus, at step 635, if the chord inversion mask and the track inversion mask allow inversions at the point identified by the selected pitch value, then a legal inversion point has been found and the scan routine 560 is exited at step 695.

If either the chord inversion mask or the track inversion mask does not allow inversions at the point identified by the selected pitch value, then processing continues at step 645. At step 645, if the selected pitch value is not equal to the pitch of the note, then additional pitch values remain to be examined and processing returns to step 620. This process will continue until either a pitch value is selected at which the chord inversion mask and the track inversion mask allow inversions or the selected pitch value equals the pitch of the note. At step 645, if the selected pitch value equals the pitch of the note, then processing continues at step 650. At step 650, each pitch value between the nearest boundary and the pitch of the note has been examined and no legal inversion points have been identified. Thus, the initial no-inversion zone defined by the upper-pitch and lower-pitch boundaries is expanded by the track and chord inversion masks. The scan routine 560 is then exited at step 695.

In a chord inversion mask only embodiment, the scan routine only examines the chord inversion mask with respect to the selected pitch values. In this embodiment, step 630 in FIG. 6 is not included. Thus, at step 625, if the chord inversion mask allows inversions at the point identified by the selected pitch value, then processing continues at step 635 with a valid inversion point having been identified.

In a track inversion mask only embodiment, the scan routine only examines the track inversion mask with respect to the selected pitch values. In this embodiment, step 625 in FIG. 6 is not included. Thus, step 630 is performed for each selected pitch value. If the track inversion mask allows inversions at the point identified by the selected pitch value, then processing continues at step 635 with a valid inversion point having been identified.

In another embodiment, the scan routine only examines the track inversion mask and the chord inversion mask at the pitch of the note. Thus, if both of the masks allow an inversion at the pitch of the note, then an inversion is performed.

Figure 7:
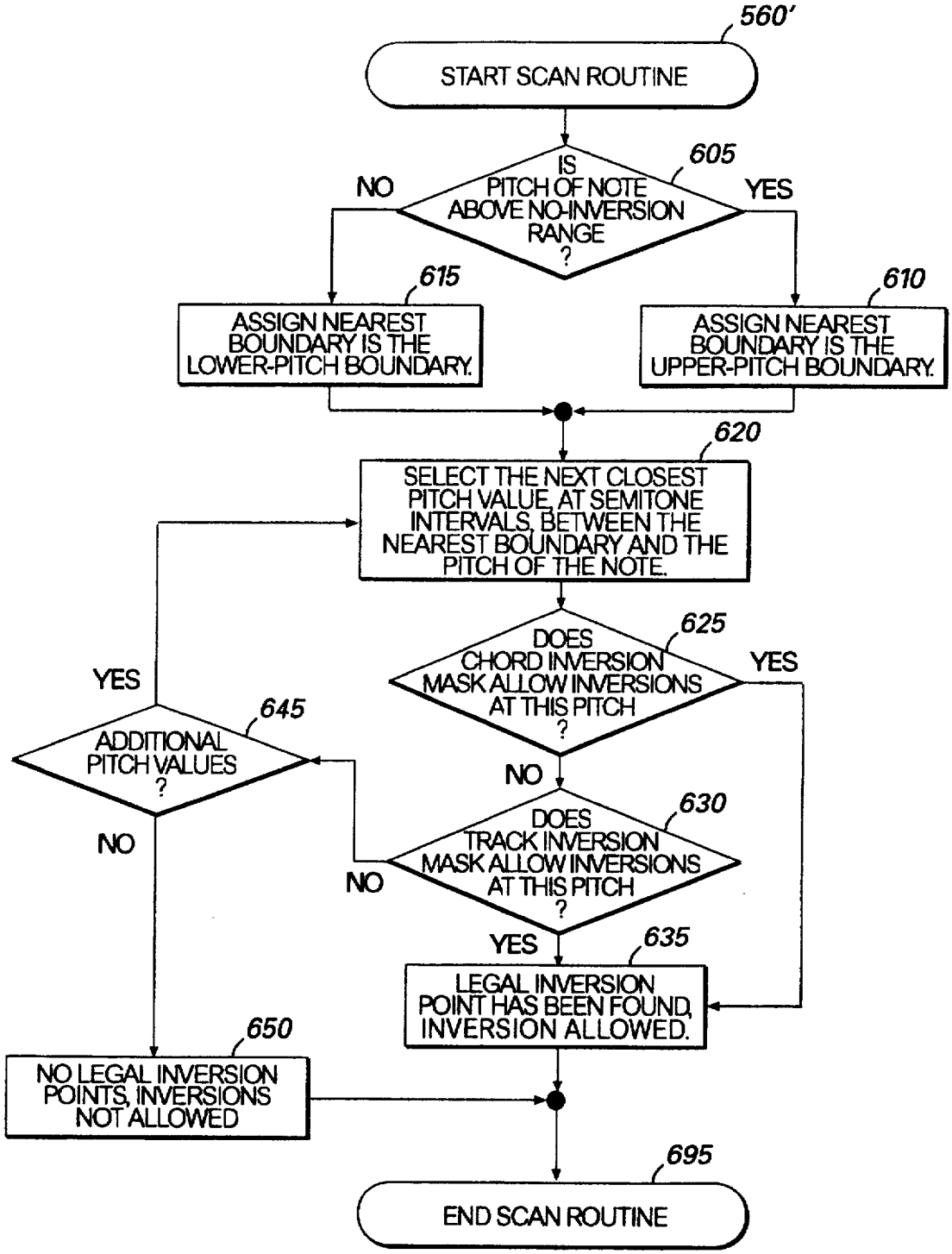
FIG. 7 is a flow diagram illustrating another embodiment of the present invention.

FIG. 7 is a flow diagram illustrating an embodiment of the present invention that allows inversion if either the chord inversion mask or the track inversion mask indicate that inversions are allowed. In this embodiment, the scan routing 560' replaces the scan routine 560. The operation of each of the steps in scan routine 560' are identical to scan routine 560 except as noted below. At step 620, the next pitch value between the nearest boundary and the pitch of the note is selected and processing continues at step 625. At step 625, the chord inversion mask is examined with respect to the selected pitch value. If the chord inversion mask allows inversions at the point identified by the selected pitch value, then processing continues at step 635 with a valid inversion point having been identified. However, if the chord inversion mask does not allow inversions at the point identified by the selected pitch value, then processing continues at step 635. At step 630, the track inversion mask is examined with respect to the selected pitch value. If the track inversion mask allows inversions at the point identified by the selected pitch value, then processing continues at step 635 with a valid inversion point having been identified. However, if the track inversion mask does not allow inversions at the point identified by the selected pitch value, then processing continues at step 645 as described in reference to FIG. 6.

Example of Exemplary Embodiment

Figure 8:
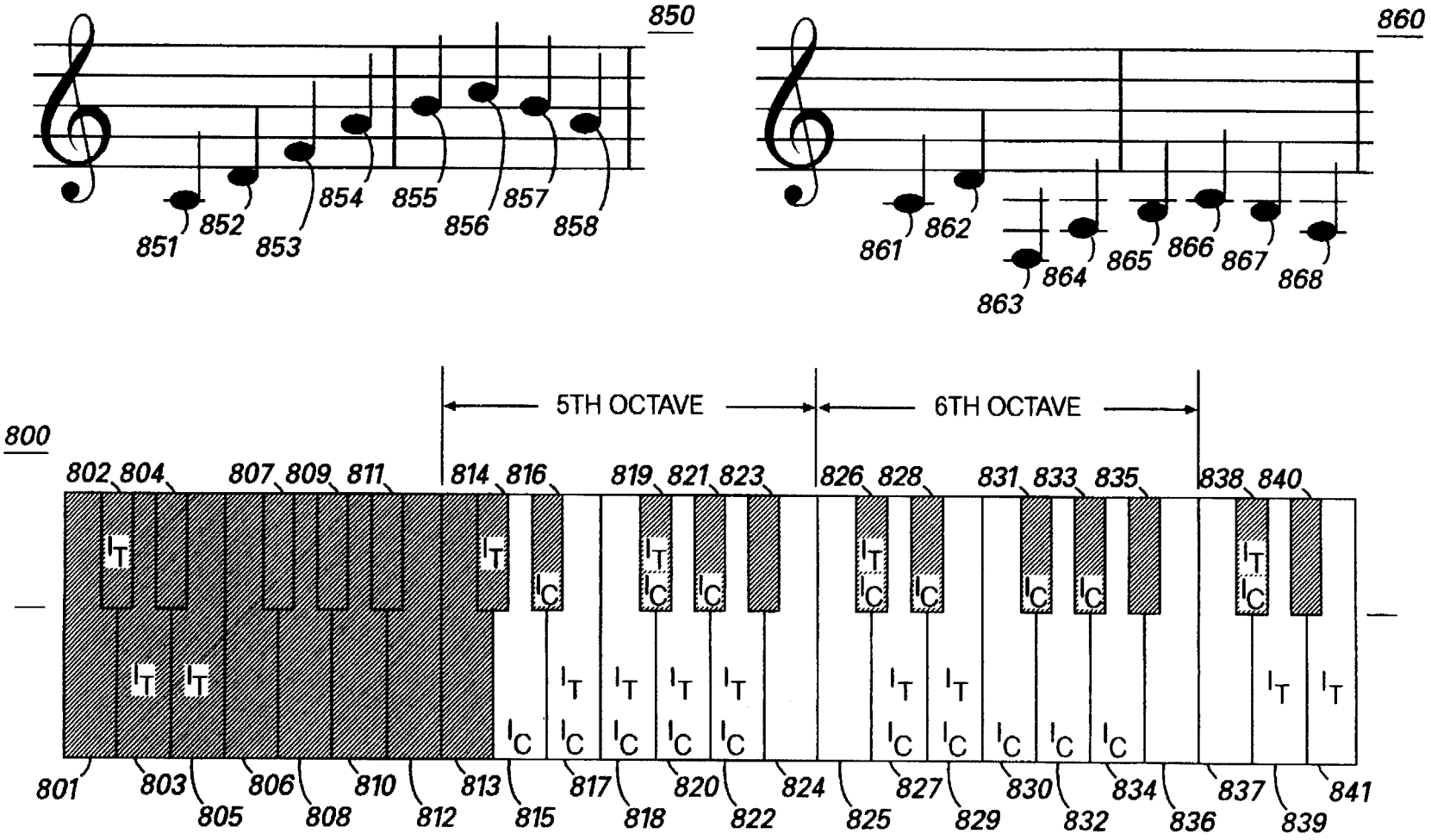
FIG. 8 is a diagram providing an example of the operation of an exemplary embodiment of the present invention.

FIG. 8 is a diagram providing an example of the operation of an exemplary embodiment of the present invention. A first musical staff 850 includes a sequences of musical notes 851–858 for a musical track. A second musical staff 860 illustrates a sequence of notes 861–868 that are derived after applying inversions to the sequence of notes 851–858 of the first musical staff 850. Thus, the configuration of the first musical staff 850 could be an input and the second musical staff 860 could be an output of an embodiment of the present invention.

A portion of a keyboard 800 including a range of keys 801–841 is illustrated with a chord inversion mask and a track inversion mask overlying it. An upper-pitch boundary of the initial no-inversion zone is synonymous with the pitch of key 813. All of the illustrated keys to the left of and including the upper-boundary pitch are included within the no-inversion zone. The chord inversion mask is indicated on the keyboard 800 by providing the symbol $I_C$ at the allowed inversion points. In this example, the same chord mask and structure of FIG. 3 has been recreated. The track inversion mask is indicated on the keyboard 800 by placing the symbol $I_T$ at scale intervals where inversions are allowed.

The note 851 of the first musical staff 850 corresponds with the lower C note (key 813) in the 5th octave of the keyboard. No inversions are performed on this note because it falls within the initial no-inversion range. Therefore, the final note 861 is generated as displayed on the second musical staff 860.

The note 852 of the first musical staff 850 corresponds with the key 815 of the keyboard 800. This note falls outside of the initial no-inversion range. Inversions are not allowed at any point between the upper-pitch boundary 813 and the key 815 associated with the note. The track inversion mask would allow an inversion at key 814, however, this is prevented by the chord inversion mask. At key 815, the chord inversion mask would allow an inversion, however, the track inversion mask prevents an inversion from occurring. Thus, the note 852 of the first staff is not inverted and is then performed as note 862 as displayed on the second staff 860. This demonstrates that the initial no-inversion range is expanded by the chord and track inversion masks. The reader will appreciate that changing chords during a musical performance, then has the effect of dynamically changing the boundaries of the no-inversion zone.

The note 853 of the first musical staff 850 corresponds with the key 818 of the keyboard 800. Performing the scan process between the upper-pitch boundary (key 813) and the key 818 corresponding with the note 853 indicates that the note 853 can be inverted because the track inversion mask and the chord inversion mask both allow inversions at the key 817. Thus, the note 853 of the first musical staff 850 is inverted to produce note 863 as displayed on the second musical staff 860.

Similarly, the notes 854–858 of the first musical staff 850 correspond respectively to keys 822, 824, 825, 824 and 822 of keyboard 800 and fall outside of the initial no-inversion range. The track inversion mask and the chord inversion masks both allow inversions at key 817, thus, each of the notes 854–858 are inverted. The resulting notes 864–868 are illustrated on the second musical staff 860.

CONCLUSION

From the foregoing description, it will be appreciated that the present invention provides a system and a method for intelligently controlling note inversions during a computer based musical performance. During a musical performance, notes of a track are transposed against a chord. In some instances, the resulting pitch of the transposed note may fall outside of an upper-pitch boundary or a lower-pitch boundary defined for the track. When this occurs, two additional control mechanisms are examined to determine if the note should be inverted. One mechanism includes a chord inversion mask. Each chord in the musical performance includes a chord inversion mask for managing the inversion of notes within the context of the chord. In one embodiment, the range of the chord inversion mask is two octaves and the lowest pitch value of the range is aligned with the root note of the chord. Another mechanism includes a track inversion mask. Each track includes a track inversion mask defining one or more series of ranges where inversions are allowed. In one embodiment, the range of the track inversion mask is ten octaves and the location of the ranges is adjusted based on the chord root. If the pitch of a transposed note exceeds the upper-pitch boundary, the chord inversion mask and the track inversion mask are scanned to determine if the note can be inverted. The scanning process includes looking at each position in the chord inversion mask and the track inversion mask between the upper-pitch boundary and the pitch of the transposed note. If a position is found in which the chord inversion mask and the track inversion mask allow inversions, then the note will be inverted. If the pitch of the transposed note is lower than the lower-pitch boundary, the scanning process occurs between the lower-pitch boundary and the pitch of the transposed note. Thus, inversions can be restricted so that melodic runs will not be broken up or certain notes within the context of a chord will not be adjusted.

The present invention may be conveniently implemented in one or more program modules. No particular programming language has been indicated for carrying out the various tasks described above because it is considered that the operation, steps, and procedures described in the specification and illustrated in the accompanying drawings are sufficiently disclosed to permit one of ordinary skill in the art to practice the instant invention. Moreover, in view of the many different types of computers and program modules that can be used to practice the instant invention, it is not practical to provide a representative example of a computer program that would be applicable to these many different systems. Each user of a particular computer would be aware of the language and tools which are more useful for that user's needs and purposes to implement the instant invention.

The present invention has been described in relation to particular embodiments which are intended in all respects to be illustrative rather than restrictive. Those skilled in the art will understand that the principles of the present invention may be applied to, and embodied in, various program modules for execution on differing types of computers regardless of the application.

Alternative embodiments will become apparent to those skilled in the art to which the present invention pertains without departing from its spirit and scope. Accordingly, the scope of the present invention is described by the appended claims and supported by the foregoing description.

We claim:

1. A method for dynamically changing the boundaries of a no-inversion zone during a performance of musical data, the musical data being received from a source and including a plurality of notes with each note being associated with one of a plurality of tracks, an upper-pitch boundary, a lower-pitch boundary, and a plurality of inversion masks, comprising the steps of:

selecting active inversion masks from the plurality of inversion masks, the active inversion masks being associated with the portion of the musical data currently being performed;

functionally merging the active inversion masks to form a master inversion mask;

defining an upper boundary of the no-inversion zone as the first point in the master inversion mask where inversions are allowed above the upper-pitch boundary; and defining a lower boundary of the no-inversion zone as the first point in the master inversion mask where inversions are allowed below the lower-pitch boundary.

2. The method of claim 1, wherein the step of selecting active inversion masks comprises the steps of:

selecting a chord inversion mask associated with a currently played chord; and selecting a track inversion mask associated with a track that is associated with a currently played note.

3. A method for controlling the inversions of notes during a performance of musical data, the musical data being received from a source and including a plurality of notes with each note being associated with one of a plurality of tracks, comprising the steps of:

receiving from the source, a lower-pitch boundary and an upper-pitch boundary defining a no-inversion range, a track inversion mask for each of the plurality of tracks, each track inversion mask identifying a plurality of scale intervals, each scale interval being identified as one of two types including a no-inversion type and an inversion type, and a chord;

for each of the plurality of notes having a pitch value above the no-inversion range when played against the chord, inverting the note if an inversion type scale interval exists in the track inversion mask of the track associated with the note, and the pitch associated with the inversion type scale interval is within a pitch range from the upper pitch boundary to the pitch value of the note, and;

for each of the plurality of notes having a pitch value below the no-inversion range when played against the chord, inverting the note if an inversion type scale interval exists in the track inversion mask corresponding with the track associated with the note, and the pitch associated with that inversion type scale interval is within a pitch range from the lower pitch boundary to the pitch value of the note.

4. A method for controlling the inversions of notes during a performance of musical data, the musical data being received from a source and including a plurality of notes with each note being associated with one of a plurality of tracks, comprising the steps of:

receiving from the source, a lower-pitch boundary and an upper-pitch boundary defining a no-inversion range, and a chord including a chord inversion mask identifying no-inversion points and inversion points over a two octave range extending from a root note of the chord;

for each of the plurality of notes having a pitch value above the no-inversion range when played against the chord, inverting the note if an inversion point exists in the chord inversion mask, and the pitch associated with that inversion point is within a pitch range from the upper pitch boundary to the pitch value of the note, and;

for each of the plurality of notes having a pitch value below the no-inversion range when played against the chord, inverting the note if an inversion point exists in the chord inversion mask, and the pitch associated with that inversion point is within a pitch range from the lower pitch boundary to the pitch value of the note.

5. A method for controlling the inversions of notes during a performance of musical data, the musical data being received from a source and including a plurality of notes with each note being associated with one of a plurality of tracks, comprising the steps of:

receiving from the source, a lower-pitch boundary and an upper-pitch boundary defining a no-inversion range, a track inversion mask for each of the plurality of tracks, each track inversion mask identifying a plurality of scale intervals, each scale interval being identified as one of two types including a no-inversion type and an inversion type, and a chord including a chord inversion mask identifying no-inversion points and inversion points over a two octave range extending from a root note of the chord;

for each of the plurality of notes having a pitch value outside of the no-inversion range when played against the chord, inverting the note if an inversion type scale interval exists in the track inversion mask of the track associated with the note, and if the pitch of that inversion type scale interval is equal to the pitch of an inversion point existing in the chord inversion mask, and if and the pitch of the inversion type scale interval is within a pitch range from the pitch value of the note to a nearest pitch boundary selected from the upper pitch boundary and the lower pitch boundary.

6. The method of claim 5, wherein the nearest pitch boundary is the upper pitch boundary, and the inverting step comprises the step of decreasing the pitch of the note in octave size increments until the pitch of the note is within the no-inversion range.

7. The method of claim 5, wherein the nearest pitch boundary is the lower pitch boundary, and the inverting step comprises the step of increasing the pitch of the note in octave size increments until the pitch of the note is within the no-inversion range.

8. A computer-readable medium having computer-executable instructions for performing the steps recited in claim 5.

9. A computer-readable medium having computer-executable instructions for performing the steps recited in claim 6.

10. A computer-readable medium having computer-executable instructions for performing the steps recited in claim 7.

11. A system for controlling note inversions during a performance of musical data received from a source, comprising:

a processing unit;

a memory storage device;

a data interface for receiving musical data from the source:

a program module, stored in the memory storage device for providing instructions to the processing unit;

the processing unit, responsive to the instructions of the program module, being operative to:

(a) receive musical data from the source over the data interface, the musical data including:

a no-inversion range defined by a lower-pitch boundary and a upper-pitch boundary, a plurality of notes arranged into at least one track with each track having a track inversion mask, each track inversion mask identifying a plurality of scale intervals with each scale interval being identified as one of two types including a no-inversion type of an inversion type, and a chord including a chord inversion mask identifying no-inversion points and inversion points over a two octave range extending from a root note of the chord; and (b) for each particular note of the plurality of notes:

if the pitch of the particular note is above the no-inversion range when played against the chord, invert the note if a common pitch value corresponding with an inversion type scale interval in the track inversion mask and an inversion point the chord inversion mask, exists within the range of the upper-pitch boundary and the pitch of the particular note, and if the pitch of the particular note is below the non-inversion range when played against the chord, invert the note if a common pitch value corresponding with an inversion type scale interval in the track inversion mask and an inversion point the chord inversion mask, exists within the range of the lower-pitch boundary and the pitch of the particular note.

12. A system for controlling note inversions during a performance of musical data received from a source, comprising:

a processing unit;

a memory storage device;

a data interface for receiving musical data from the source:

a program module, stored in the memory storage device for providing instructions to the processing unit;

the processing unit, responsive to the instructions of the program module, being operative to:

(a) receive musical data from the source over the data interface, the musical data including:

a no-inversion range, a plurality of notes arranged into at least one track with each track having a track inversion mask, each track inversion mask identifying a plurality of scale intervals, each scale interval being identified as one of two types including a no-inversion type of an inversion type, and a chord including a chord inversion mask identifying no-inversion points and inversion points over a two octave range extending from a root note of the chord; and (b) for each particular note of the plurality of notes:

if the transposed pitch of the particular note is not within the no-inversion range when played against the chord, invert the note if an inversion type scale interval in the track inversion mask and an inversion point the chord inversion mask exists at the transposed pitch.

* * * * *